US005234392A

United States Patent [19]

Clark

[11] Patent Number: 5,234,392

[45] Date of Patent: Aug. 10, 1993

[54] TRACK ATHLETE TRAINER

[76] Inventor: John Clark, Box 388, Hub Station, Bronx, N.Y. 10455

[21] Appl. No.: 796,910

[22] Filed: Nov. 22, 1991

Related U.S. Application Data

[63] Continuation of Ser. No. 479,981, Feb. 14, 1990, abandoned.

[51] Int. Cl.[5] ..... B63B 23/04

[52] U.S. Cl. ..... 482/54; 482/51; 482/112; 482/130

[58] Field of Search ..... 482/26, 27, 29, 51, 482/52, 54, 112, 113, 121, 129, 130, 122-128, 70, 71

[56] References Cited

U.S. PATENT DOCUMENTS

| | | | |
|---|---|---|---|
| 1,016,729 | 2/1912 | Barrett . | |
| 2,017,128 | 9/1934 | O'Neill, Jr. . | |
| 3,638,941 | 2/1972 | Kulkens | 482/130 X |
| 3,756,595 | 9/1973 | Hague | 482/70 |
| 3,770,267 | 11/1973 | McCarthy | 482/130 |
| 3,936,047 | 2/1976 | Brandt et al. | 482/130 X |
| 3,970,302 | 7/1976 | McFee | 272/130 |
| 3,992,004 | 11/1976 | Feron et al. | 482/128 |
| 4,026,548 | 5/1977 | Birdwell . | |
| 4,111,417 | 9/1978 | Gardner | 482/128 |
| 4,223,887 | 9/1980 | Holtz | 482/51 |
| 4,278,095 | 7/1981 | Lapeyre | 272/69 X |
| 4,285,041 | 8/1981 | Smith | 272/70 X |
| 4,336,933 | 6/1982 | Appelbaum | 272/70 |
| 4,340,214 | 7/1982 | Schützer | 482/51 |
| 4,494,662 | 1/1985 | Clymer | 482/130 X |
| 4,512,571 | 4/1985 | Hermelin | 482/70 |
| 4,516,768 | 5/1985 | Gallard | 482/51 X |
| 4,522,392 | 6/1985 | Torii | 482/128 |
| 4,548,405 | 10/1985 | Lee et al. | 272/65 X |
| 4,645,197 | 2/1987 | McFee | 272/65 |
| 4,754,964 | 7/1988 | Michaels | 272/130 X |
| 4,762,363 | 8/1988 | Hart | 272/130 |
| 4,772,014 | 9/1988 | Rebman | 272/70 X |
| 4,772,016 | 9/1988 | Manion | 272/130 |
| 4,781,372 | 11/1988 | McCormack | 272/51 X |
| 4,796,881 | 1/1989 | Watterson | 272/130 X |

FOREIGN PATENT DOCUMENTS

| | | | |
|---|---|---|---|
| 2327948 | 12/1974 | Fed. Rep. of Germany | 272/69 |
| 1437045 | 11/1988 | U.S.S.R. | 482/70 |
| 331825 | 7/1930 | United Kingdom | 482/51 |

*Primary Examiner*—Robert Bahr
*Attorney, Agent, or Firm*—Gottlieb, Rackman & Reisman

[57] ABSTRACT

A hydraulic track exerciser for training a runner having a platform on which a user runs, wherein the runner's forward movement is opposed by the predetermined variable resistance of spring mounted hydraulic cylinders in a running platform, and in a tethered post and a computer generated scene of a runner travelling along a road, with relevant information superimposed on the screen.

9 Claims, 4 Drawing Sheets

TRACK ATHLETE TRAINER

This is a continuation of copending application Ser. No. 07/479,981, filed on Feb. 14, 1990, now abandoned.

BACKGROUND OF THE INVENTION

This invention relates to track exercisers. In particular it relates to such exercisers in which the resistance to forward movement of the runner increases in a controlled manner as running speed increases. In addition it relates to such exercisers having an associated video exercising scene to feedback detailed information to the runner.

Athletic exercising devices are known which can be used by runners off the track to exercise themselves. For the most part these consist of conveyer belts on which the runner can practice. For example U.S. Pat. No. 1,106,729 disclosed a treadmill made up of parallel slats supported on a large number of rollers to maintain a flat upper surface on which a user runs. The user is tethered to a restraining device that prevents him or her from running off the tread. The device also allows use by a pedestrian for walking exercise. The only information fed back to the user is provided by a speedometer which monitors the velocity of the tread.

U.S. Pat. No. 2,017,128 is a similar device, designed to exercise hikers. It also uses a tread-mill type endless belt, having its upper surface supported on a sheet of metal and made of a flexible fabric. The device is designed to be inclinable before use so the hiker may simulate walking "uphill". A tether to restrain the hiker is spring tensioned and connected to the hiker via a belt passing around the hiker's abdomen.

U.S. Pat. No. 4,026,548 is an exercise device allowing a runner to tether himself to a door and to run on the surface of a floor against the bias of a spring. This permits limited indoor exercise by a traveller in, say, a hotel room.

None of the foregoing devices particularly facilitate a training program that takes into account the need of track athletes to develop great aerobic capacity, leg strength and endurance. In particular, each of the foregoing devices seeks only to provide an alternative to running or walking outdoors. It does not enable the user to improve training performance over what could be accomplished outdoors. The present invention on the other hand provides training superior to what the user would be able to accomplish in a more natural environment.

BRIEF DESCRIPTION OF THE INVENTION

The present invention is a track exerciser which enables and encourages a specific fitness program for exercise, particularly of the aerobic type, for cardio-vascular fitness. The user is held in a tether restraint and runs on a novel hydraulic track exerciser platform designed to stress him or her in a predetermined manner while a metronome provides an audible pace and a screen displays the user's speed, distance accomplished, and other information.

It is an object of the present invention to provide a hydraulic track exerciser on which a user runs, wherein the runner's forward movement is opposed by the predetermined variable resistance of spring mounted hydraulic cylinders in a running platform, and in a tethered post.

It is a further object of the present invention to provide such an exerciser having monitoring means for determining the state of the runner, in particular, one in which the platform contains a recording device for transmitting information on the rate of the foot strike of the runner to a central control.

It is a further object of the present invention to provide such an exerciser having a display system for displaying to the runner information regarding time, speed, heart beat and resistance being employed against the hydraulic system.

It is a still further object of the present invention to provide such a system having a computer generated scene of a runner travelling along a road, or track, with all relevant information superimposed on the screen.

It is a yet further object of the present invention to provide a system of programming such an apparatus so that the system functions in a purely automatic mode of instruction, or in response to keyboard commands, or a combination of both.

DETAILED DESCRIPTION OF A PREFERRED EMBODIMENT

Figure 1:
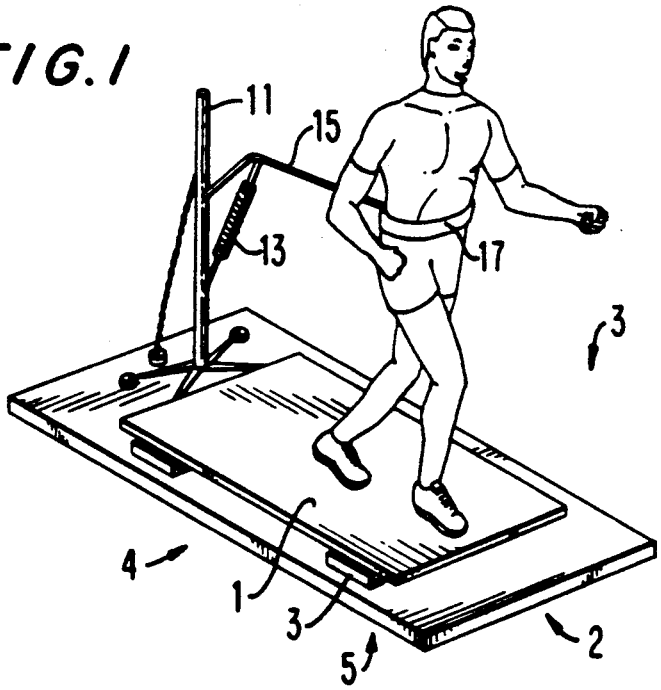
FIG. 1 is a perspective view of a runner on the running platform of the present invention.
Figure 2:
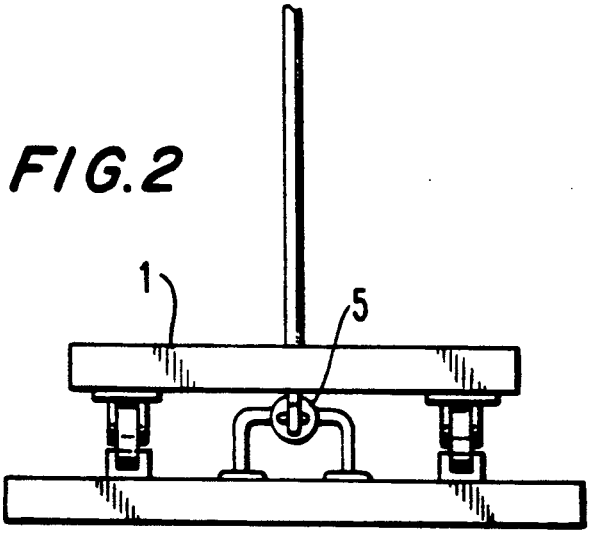
FIG. 2 is a front plan view of the running platform of the present invention.
Figure 3:
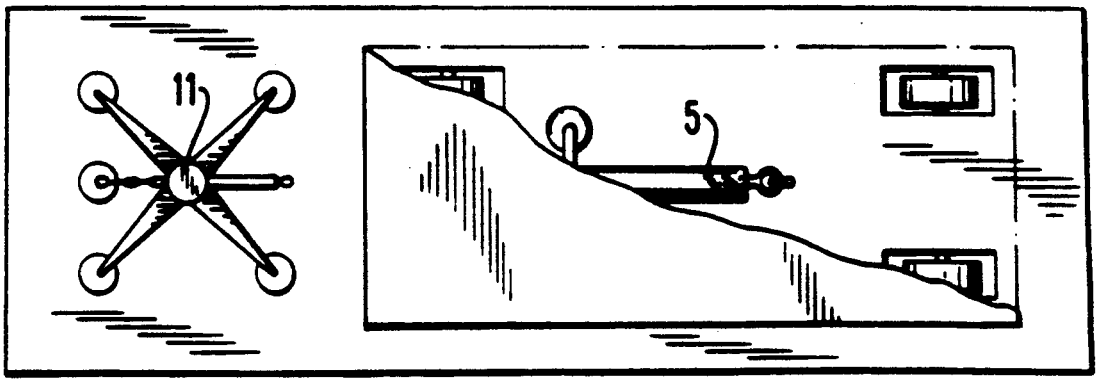
FIG. 3 is a top plan view of the running platform of the present invention.
Figure 4:
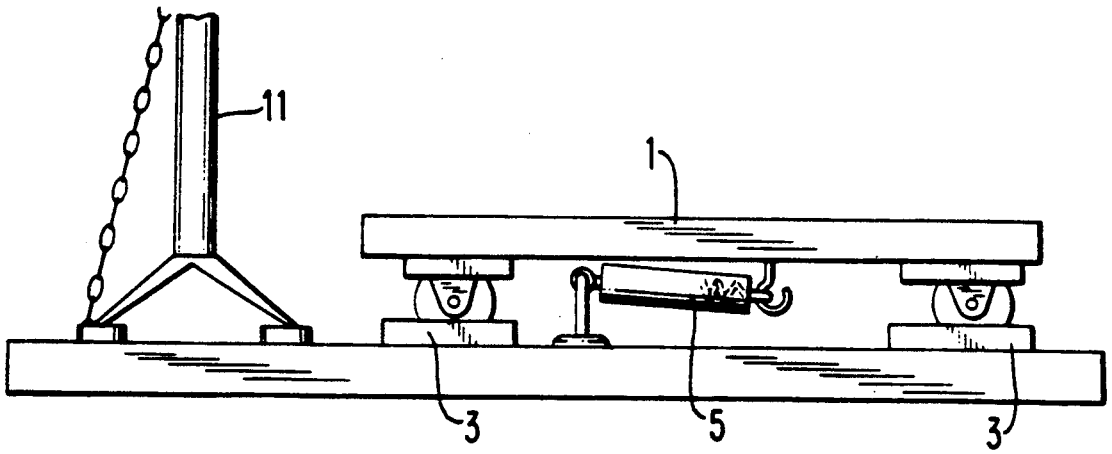
FIG. 4 is a side plan view of the running platform of the present invention.
Figure 5:
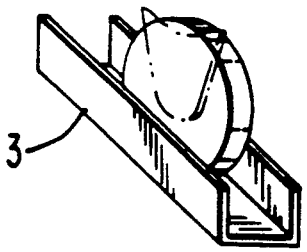
FIG. 5 is a perspective view of a support wheel for the running platform of the present invention.
Figure 6:
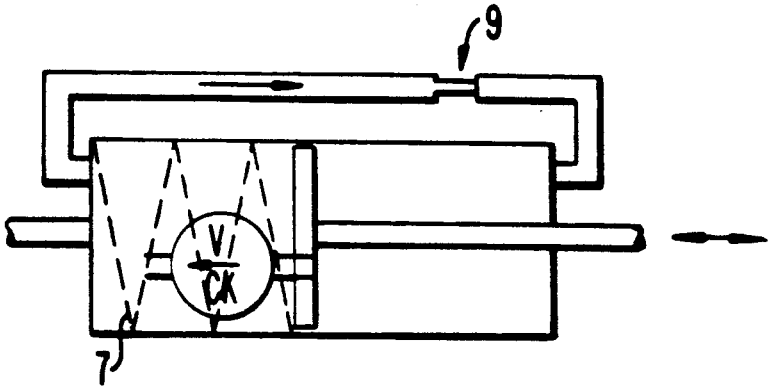
FIG. 6 is an enlarged side plan view of a hydraulic cylinder for the running platform of the present invention.
Figure 7:
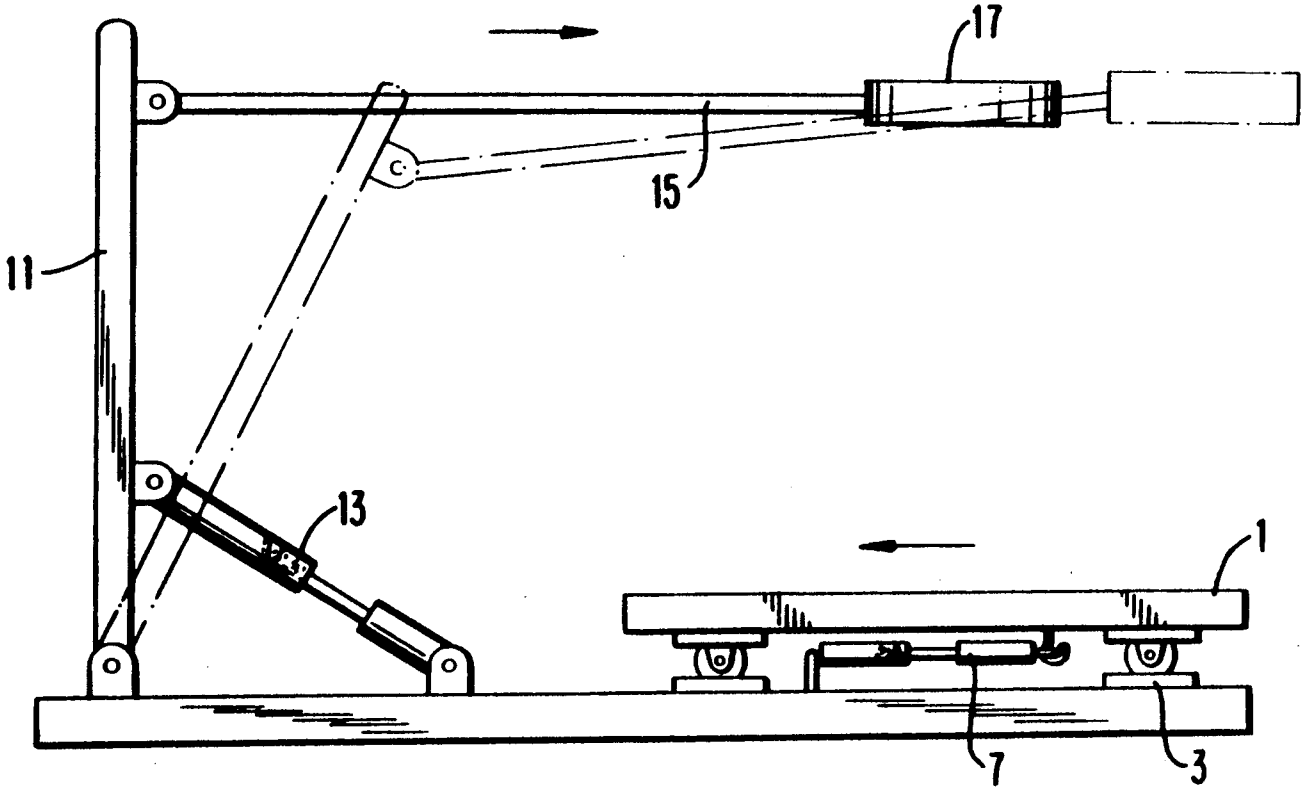
FIG. 7 is a side plan view of the restraining means and the running platform of the present invention.

The running platform portion of the apparatus in its preferred embodiment is depicted in FIGS. 1–7. In this embodiment a moveable platform 1 is supported by wheels that ride on tracks 3 to enable a short oscillatory motion. A spring-loaded hydraulic mechanism 5, whose details are best seen in FIG. 6 is placed underneath the platform 1 and restrains the motion of the platform. The spring 7 and the hydraulic restriction 9 act to provide controlled resistance, in the manner of an automobile shock absorber, against which the user runs. The amount of resistance may be adjusted by an adjustment of the spring tension, or the hydraulic or pneumatic restriction. The platform oscillates in response to the driving force of the runners foot and tends to return to the initial position while both feet are off the platform; therefore it is not suitable for wa king exercise. The resistance of the platform may be tailored by its mechanism to provide resistive forces substantially greater or less than the wind-resistive and body mass forces experienced outdoors. With this apparatus the runner is able to achieve a rate of cardiac stimulation that is not determined solely by the number of steps per minute (spm) that he takes.

Behind the runner, on the same platform is mounted a tether-post 11 which is pivoted to move backward and forward against hydraulic resistance 13 or a spring load.

A lead 15 with a belt 17 attached is connected to the runner's waist to prevent his running off the platform.

Figure 8:
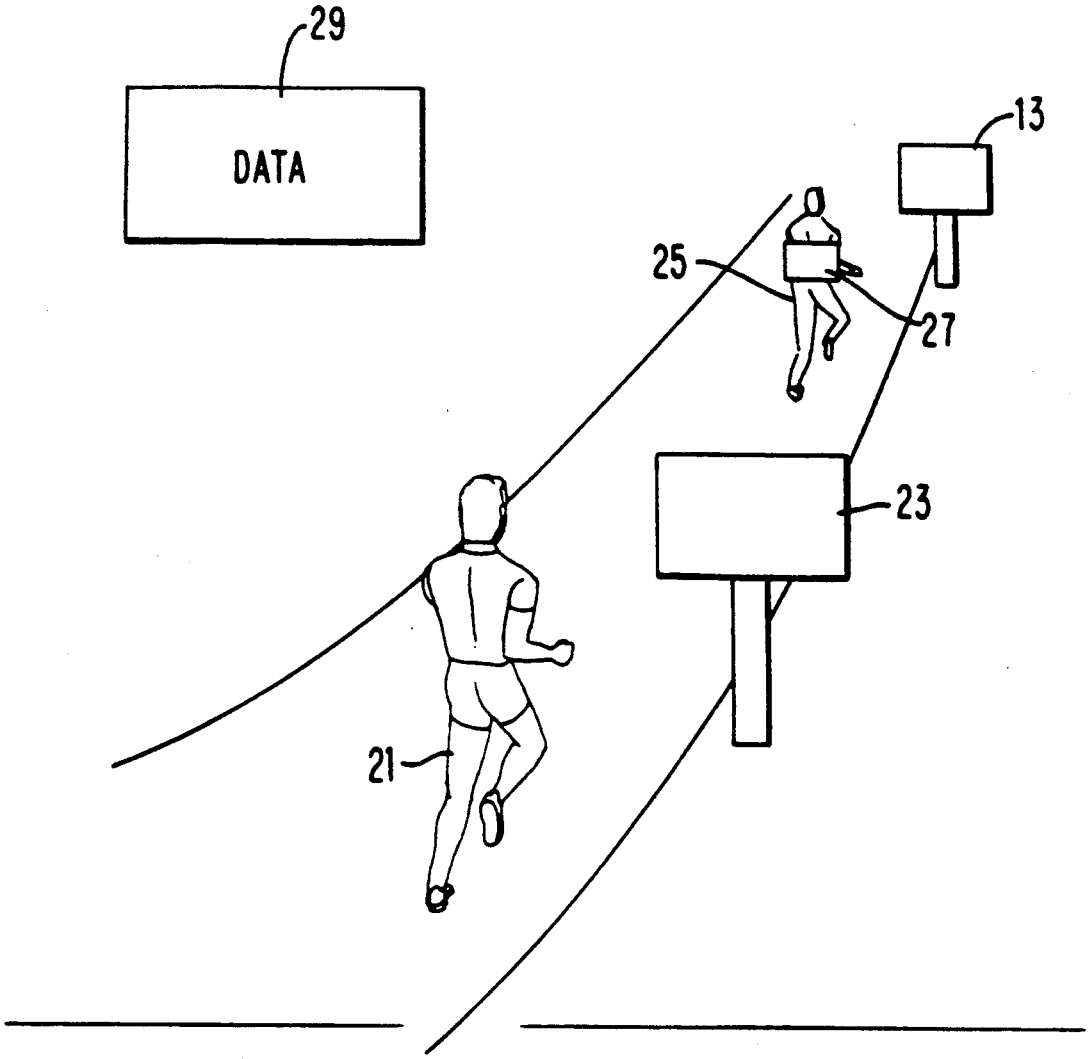
FIG. 8 is view of the display screen of the present invention.

A computer generated exercising scene, see FIG. 8, (preferably a runner on a road or track) is shown to the user on a display. Information from the platform on the velocity and rate of oscillation of the platform in cycles per minute is provided to a controller (not shown) for integration into the image on the display or for other use. The user's foot strike (on the hydraulic track) for example controls the speed of the video FIG. 21 in the scene. Sign-posts 23 by the side of the road provide distance information. Other figures on the display, generated by a program or keyboard instruction, can be made to represent target figures to be matched at increasing and decreasing speed. A pulsing FIG. 25 on the screen is a target pacer. A number on his back 27 is the speed (in steps per minute or time) to be duplicated. As exercising speed of the runner approaches that of the pacing figure, it pulses more slowly and then blips out when the speed of the video pacer and that of the exerciser coincide. The speed signal is converted to the reciprocal of speed, i.e. minutes per mile, or seconds per 220, 440 or 880 yards, and is displayed 29 on the monitor. The user's heart rate is monitored by a receiver from a cardiac transducer transmitter on the runner's chest and converted into three digits of beats per minute, and also superimposed on the video monitor.

In use, the runner mounts the platform facing away from the tether-post behind. He attaches the belt around his waist. As he runs, he pulls against the resistance of the hydraulic mounted tether, and pushes backward against the resistance of the spring biased hydraulic platform. While there is little movement in his running position, the effort of every stride he takes is determined by the resistance settings of the tether and the platform.

The hydraulic system increases the resistance to forward movement as the rate of speed increase. In the ordinary running situation, one runs against ones bodyweight, which is constant and relatively light in regard to the greater variable pressure from the tether and platform. As a result, a much greater amount of energy and muscle effort is required to run on the hydraulic track. This leads to the development of a greater aerobic capacity, leg strength and endurance.

It has been found that only aerobic exercises promote cardio-vascular fitness. This is because such exercises significantly increase the continuous flow of blood through the heart and large skeletal muscles. The better aerobic exercises are walking briskly, jogging, cycling at rapid speed, running, swimming, ice or roller skating and rope skipping. To achieve this benefit, the exercises that generally move both arms and legs vigorously have to be sustained at a target level for 20 minutes or longer. For proper training a target level of activity should be maintained between 90 and 95 percent of the maximal attainable heart rate; roughly 220 minus the user's age in years. Women reach the same maximal heart beats as men of comparable age. Exercises at below 70 percent of the target level yields little fitness benefit.

An appropriate fitness program implemented by the present invention should consist of three basic stages; namely, warmup, interval running and cool down. The warmup period should consume 30 to 45 minutes of running and stretching and the heartbeat should be about 110–120 at the warmup period conclusion. Immediately after the warmup period the exercise should be more vigorous until a target level of cardiac activity is reached, and then sustained for a period of time. The cool down period should ease up on the exercise over a 5 to 10 minutes period before stopping. At the end of the cool down period, the pulse should be back to the specified target zone of the heart beat.

This program should be practiced no less than three times weekly. The problem which is dealt with by the present invention is to facilitate the program and to encourage the user to be persistent in the program.

The preferred embodiment of the mechanical aspects of the invention comprises apparatus on which the user runs together with apparatus to monitor appropriate parameters of the program and to display them in a helpful manner. All of the monitored parameters, along with an outdoor exercise display, encourage the use to persist in his or her effort. This is enhanced by the fact that the user may refer to charts or his memory to maintain activity within the target zone and to regulate his output accordingly.

The base pulse performs two functions. It gives a picture of the level of cardiac efficiency and improvement as evidenced by a falling pulse over time, and it gives a measure of how well an athlete is responding to an exercise session by the way the pulse responds. If the base pulse (determined by a reading after 48 hours rest), increases by 10 percent or more, it signals overstress and the athlete is at high risk from possible injury. If the pulse stays between a 3 to 6% increase, that is indicative of increased fitness. If the pulse increase is 0%, then clearly the workout is insufficient. The pattern desired is one of an elevated pulse the rest day after exercising, followed by a falling pulse in another 24 hours, and another elevated pulse after another work session. In a three-session-a-week program, the lowest pulse should occur after the two day rest. This is compared on a weekly basis to determine signs of improvement of cardiac function.

The present invention eliminates one problem of efficient cardiac exercising, by enabling the user to maintain a submaximal level of effort without crossing the line into over-stress. One hundred percent stress causes physiological and psychological breakdown if sustained for long, yet the highest of progress occurs in the region of $95\% \pm \approx 2.5\%$. The ability to closely monitor the underlying process enabled by the present invention is very important. By using the heartbeat as the index of stress, and employing the process monitor of the present invention, one is able to set the outer limits of exertion around 95% by controlling the heart beat through the monitoring control of the running speed. After the warm up phase is completed, the runs are done in fast/slow intervals. Once the target pulse has reached approximately 190 beats per minute (b.p.m.), the steps per minute is adjusted in increments to maintain the pulse constant for a given time period.

In the preferred embodiment of the present invention the pulse rate becomes the deciding factor to determine the point of termination of the workout; termination could be based on the rate of recovery. A system which detects a recovery pulse above 110 b.p.m. after say 5 minutes would terminate a training session in which the runner's pulse registered 120 b.p.m., thereby terminating the session to avoid going into overstress. Built into the invention is an automatic adjustment of such incidental factors as failure to sufficiently recover from previous sessions, a high level of mental stress, or illness and extreme environmental temperature or humidity. Since the pulse is responsive to all these factors, the target zone would be reached at a lower level of work, and the recovery failure would set in after a shorter period of work. The matter of training would not be decided on the subjective state of appearance, but on solid physiological evidence.

Operation can be provided in two modes: manual and automatic. In the automatic mode, one sets the time/-speed for the fast run and the time/speed for the slow recovery run. Given the target heart rates the monitor would maintain the cardiac rate by given incremental amounts of increasing or decreasing rate of steps per minute. The workout would be terminated when recovery does not occur to below a given heartbeat rate, e.g. 110 b.p.m. in time: 2 to 5 minutes at the end of the slow recovery run. In the manual mode one exercises to a pre-entered program, with or without a cardiac monitored override, or responding to keyboard instructions as given from time to time. The heart rate is still projected on he video monitor for the trainer to see.

The display of the heart beat is of tremendous value for an aerobic exercise program, and the display of the personal parameters in a speed controlled scene are informative and motivating.

The invention allows programming for different results: speed or endurance at varying levels of speed depending on the race being trained for. Strike and stride can be correlated over a given distance on the track by using a pedometer to find out he number of strikes taken in a given distance. Distance divided by the number of steps gives the length of stride. Running at metronome speed over a predetermined distance will also train the runner to achieve the correct number of steps per minute pace given for example, a 440 yard distance in 60 seconds and a 86 inch stride. This can be simply extrapolated by persons of skill in this art to determine how many steps per minute a runner must be able to run in order to achieve 440 yards in 53 seconds.

The apparatus of the present invention can be programmed for steady incremental improvements in performance to a certain (warm up) heartbeat over a given time, e.g. increasing 5 steps per minute every minute to a heart beat of 120. Then it could hold this rate for 5 minutes. During the work phase, the objective is defined in terms of speed or pulse and recovery. Given the steps per minute 220 the computer would maintain it for a given period then fall off to a lower given recovery beat, until the heart recovers, then run again at a fast steps per minute. This could be continued till the recovery proves inadequate, until the heart's reserve capacity is exhausted to a certain point.

By enabling small but real incremental progressions the invention avoids the problem of overstress when the adjustments are too great, and consequently staleness or burn-out. This situation becomes very critical at a high level of athletic performance. By the time physical signs of distress have become apparent, the athlete is already in deep trouble and the work has to be drastically reduced. Once over-stress is reached, physiological recovery is no longer a simple matter. Down time becomes very long and the athlete has to be slowly brought back to his former performance.

The following devices are used in connection with the invention:

(1) A full length mirror is place in front of the track so that the athlete can watch himself running. The mirror allows a constant evaluation of the runners form.

(2) A strobe light synchronized to the metronome and activated by the foot strike as an aid to helping the athlete improve his coordination with the beat. The athlete could also see himself running in slow motion while in fact running at high speed.

(3) At speeds of 220 steps per minute or higher, it becomes harder to distinguish the individual beats. By adding a different tone at set intervals the total structure is segmented and the athlete now simply listens and tries to keep pace by counting off he strikes between the base tone.

(4) Running in total darkness except for one focal point of light on the video screen, aids the athlete to develop a sense of physical balance which is very necessary at high speed.

(5) A radio transmitter (cordless headphone) to be attached to the runner and capable of communication with the central control.

(6) An electronic metronome capable of providing a beat of varying speeds for varying lengths of time in one continued sequence.

(7) A process monitor capable of engaging the cardiac transmitter and metronome in such a fashion as to be able to maintain a given heart rate by speeding up or slowing down the rate of foot strike of the user or for maintaining different heart rates for given intervals.

(8) A recording device capable of reproducing the total operation in terms of numerical figures or charts and graphs.

In use by a trainer the hydro-electronic track of the present invention has the following advantages:

A. The runner is in control. The machine is responsive to the athlete's action, but at no time does he feel in danger.

B. The machine accents the same muscular sequences as running but with an increased effort that can only be achieved at high speed on an outdoor track.

C. The use of a halter allows for proper running action at high speed without fear of falling. The hands are freed to run normally rather than for holding on.

D. The halter can be used as a line to introduce leads for monitoring equipment, without interfering with normal running action.

E. Because of the normal running form, the hydro-electronic track can be used to critique runner form visually, by strobe, or video tape.

F. The result of training on the hydro-electronic track produces a stronger muscular development due to running against increased resistance.

G. Speed can be taught by running to the electronic pacer a increasing strikes per minute.

H. For stress testing, the fear of the apparatus is a smaller factor in tests, therefore giving more accurate data regarding a runner's true physical condition.

I. Sudden stops at high speed do not result in injury.

J. It frees both athletes and coaches from the control of the weather, and allows the operation of a year round program.

K. Because of its high absorbing capacity, runners have a much lower rate of injury and can therefore train at a higher intensity or greater frequency.

L. Speed adjustments can be abrupt, from second to second. No acceleration o deceleration time is required of the hydroelectronic track which makes it appropriate for interval or intermittent runs.

M. Speed adjustments can be made in very small increments from day to day which is barely noticeable by the athlete, but does add up significantly over a period of time.

N. Runners can learn high speed coordination well in advance of their ability to do so on the outdoor track.

O. There is sufficient evidence to suggest that speed on the hydro-electronic track is directly related to actual performance and it is in this way that athletes record times can be improved by design.

There are three areas in which this system could be operative: athletic training, medical rehabilitation and stress testing.

In athletic training this system would give a decided advantage because of its ability to maintain maximum efficiency in training over any of the present systems of exercising. It affords greater precision in evaluating the effect of exercising and in being able to predict the possible outcome, not just waiting for the results in advance and act accordingly. Over-training (overstress) and "burn out" can be avoided by the addition of a base pulse, and the whole system can be fine tuned to the individual performer rather than to some gross approximation.

In medical rehabilitation, one can prevent over-exertion by setting the safe zone, and setting the cardiac monitor, in conjunction with the metronome pacer to determine the work load. The degree of exercise can be increased in small incremental amounts on a daily basis. The monitoring system ensures that the patient will exercise within the prescribed limits.

In the case of stress testing, one is running at a speed provided by the pacer which can be terminated at any moment without fear of being flung off the apparatus. Stress testing is done in terms of the steps per minute required to reach and maintain a certain heart rate for a specific time. The greater the number of steps per minute per heart beat, the better the efficiency. Recuperative ability can be judged in terms of the degree of recovery to a certain heartbeat within a given time. In this way, one avoid the significant factor of stress associated with a fear of being out of control as when running fast on a treadmill. The whole procedure then becomes less life threatening to the patient, and the testing results are more accurate in terms of the specific information sought.

Although the invention has been described in terms of a particular embodiment, it should be understood that the invention is not limited to just that single embodiment, but is intended to encompass the subject matter defined by the following claims and their equivalents.

I claim:

1. A method for training a runner comprising having the runner run on a running platform consisting essentially of:

a track having guides;

a single running platform supported on said guides, said guides including means for supporting the runner's weight thereon and for enabling horizontal oscillatory motion of said platform, and said platform comprising a flat surface of sufficient width to simultaneously support both feet of a runner standing thereon; and, a spring loaded hydraulic damper mounted between said track and said running platform and restraining said platform from free horizontal oscillation parallel to and in the direction of the runner's backward foot motion such that said platform moves in the direction of the runner's backward foot motion against said spring loaded hydraulic damper in response to the driving motion of the runner's foot, and said spring loaded hydraulic damper moves said platform in the opposite direction when the driving motion is removed, said platform adapted to provide information on its motion to a central controller, restraining said runner from running off said platform by means attached to a tether post and comprising belt means adapted to be worn by the runner, displaying on a video display means information from said central controller and displaying an exercising scene comprising a video figure, sign posts, a pulsing target figure having a speed figure displayed on its back, and a speed indication, monitoring the runner's heartbeat and providing heartbeat information to said central controller, and maintaining the runner's heart rate by training the runner to maintain his rate of foot strike for given intervals.

2. The method for training a runner of claim 1 wherein said step of displaying on a video display further comprises the step of displaying an exercising scene comprising a video figure, sign posts, a pulsing target figure having a speed figure displayed on its back, and a speed indication.

3. A method for training a runner on a hydraulic track exerciser comprising supporting a runner on a running platform, said platform consisting essentially of:

a track having guides;

a single running platform supported on said guides, said guides including means for supporting the runner's weight thereon and for enabling horizontal oscillatory motion of said platform, and said platform comprising a flat surface of sufficient width to simultaneously support both feet of a runner standing thereon; and, a spring loaded hydraulic damper mounted between said track and said running platform and restraining said platform from free horizontal oscillation parallel to and in the direction of the runner's backward foot motion such that said platform moves in the direction of the runner's backward foot motion against said spring loaded hydraulic damper in response to the driving motion of the runner's foot, and said spring loaded hydraulic damper moves said platform in the opposite direction when the driving motion is removed.

4. A track exerciser for training a runner consisting essentially of:

a track having guides;

a single running platform supported on said guides, said guides including means for supporting the runner's weight thereon and for enabling horizontal oscillatory motion of said platform, and said platform comprising a flat surface of sufficient width to simultaneously support both feet of a runner standing thereon; and, a spring loaded hydraulic damper mounted between said track and said running platform and restraining said platform from free horizontal oscillation parallel to and in the direction of the runner's backward foot motion such that said platform moves in the direction of the runner's backward foot motion against said spring loaded hydraulic damper in response to the driving motion of the runner's foot, and said spring loaded hydraulic damper moves said platform in the opposite direction when the driving motion is removed.

5. The track exerciser of claim 4, comprising restraining means attached to a tether post and comprising belt means adapted to be worn by the runner.

6. The track exerciser of claim 4 comprising video display means adapted to display an exercising scene comprising a video figure representing the runner, a target figure, a target speed figure, and a current speed indication.

7. The track exerciser of claim 7 further comprising heartbeat monitoring means and transmitter means adapted for connection to the runner's chest and adapted to provide information to said central controller.

8. The track exerciser of claim 4, wherein said running platform is adapted to provide information on its motion to a central controller, and said track exerciser further comprises video display means adapted to receive information from said central controller and to display an exercising scene comprising a video figure, a target figure having a speed figure displayed and a speed indication.

9. The track exerciser of claim 8 further comprising heartbeat monitoring means and transmitter means adapted for connection to the runner's chest and adapted to provide information to said central controller.

* * * * *